US008997377B2

(12) United States Patent
Kim et al.

(10) Patent No.: US 8,997,377 B2
(45) Date of Patent: Apr. 7, 2015

(54) CLOTHES TREATMENT APPARATUS AND METHOD FOR CONTROLLING A CLOTHES TREATMENT APPARATUS

(71) Applicant: LG Electronics Inc., Seoul (KR)

(72) Inventors: Youngsuk Kim, Seoul (KR); Hyojun Kim, Seoul (KR); Sangwook Hong, Seoul (KR); Naeun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 107 days.

(21) Appl. No.: 13/650,223

(22) Filed: Oct. 12, 2012

(65) Prior Publication Data

US 2013/0091726 A1 Apr. 18, 2013

(30) Foreign Application Priority Data

Oct. 13, 2011 (KR) ..... 10-2011-0104391
Oct. 21, 2011 (KR) ..... 10-2011-0108097

(51) Int. Cl.

| | |
|---|---|
| ***D06F 58/22*** | (2006.01) |
| ***F26B 21/00*** | (2006.01) |
| ***D06F 58/28*** | (2006.01) |
| *D06F 58/20* | (2006.01) |

(52) U.S. Cl.

CPC ..... *D06F 58/22* (2013.01); *D06F 58/20* (2013.01); *D06F 58/28* (2013.01); *D06F 2058/2829* (2013.01); *D06F 2058/2858* (2013.01); *D06F 2058/2864* (2013.01)

(58) Field of Classification Search

CPC ..... F26B 3/00; F26B 5/00; F26B 11/00; F26B 11/21; F26B 21/00; D06F 58/00; D06F 58/22

USPC ..... 34/427, 601, 606, 610

See application file for complete search history.

(56) References Cited

U.S. PATENT DOCUMENTS

| | | | | |
|---|---|---|---|---|
| 4,700,492 | A * | 10/1987 | Werner et al. | 34/403 |
| 4,891,892 | A * | 1/1990 | Narang | 34/86 |
| 5,097,606 | A * | 3/1992 | Harmelink et al. | 34/467 |
| 5,768,730 | A * | 6/1998 | Matsumoto et al. | 8/159 |
| 6,671,977 | B2 * | 1/2004 | Beaumont | 34/79 |
| 7,073,273 | B2 * | 7/2006 | Kim | 34/595 |
| 7,882,647 | B2 * | 2/2011 | Ikemizu | 34/524 |

(Continued)

FOREIGN PATENT DOCUMENTS

| | | | |
|---|---|---|---|
| DE | 3376663 | * | 6/1988 |
| DE | 40 34 273 | | 4/1992 |

(Continued)

OTHER PUBLICATIONS

European Search Report dated Jan. 24, 2013.

*Primary Examiner* — Steve M Gravini
(74) *Attorney, Agent, or Firm* — Ked & Associates, LLP

(57) ABSTRACT

A clothes treatment apparatus and a method for controlling a clothes treatment apparatus are provided. The clothes treatment apparatus may include a drying duct, a first blower fan located in the drying duct that circulates interior air within the drying duct, and a filter located in the drying duct. The method may include sensing clogging of the filter, and switching a flow of air passing through the filter from a first direction to an opposite second direction if clogging of the filter is sensed. The method may further include a washing cycle for washing clothes, and a drying cycle for drying the clothes. An implementation time of the washing cycle may be less than an implementation time of the drying cycle.

17 Claims, 13 Drawing Sheets

(56) References Cited

U.S. PATENT DOCUMENTS

| | | | | |
|---|---|---|---|---|
| 7,926,201 | B2 * | 4/2011 | Kim et al. | 34/524 |
| 7,997,006 | B2 * | 8/2011 | Son et al. | 34/381 |
| 8,042,284 | B2 * | 10/2011 | Yoo et al. | 34/601 |
| 8,387,272 | B2 * | 3/2013 | Kim et al. | 34/524 |
| 2004/0006886 | A1 | 1/2004 | Lee et al. | |
| 2006/0007557 | A1 | 1/2006 | Davidson | |
| 2010/0146812 | A1 | 6/2010 | Ahn et al. | |

FOREIGN PATENT DOCUMENTS

| | | | |
|---|---|---|---|
| DE | 197 55 916 | | 6/1999 |
| DE | 10 2009 001 610 | | 9/2010 |
| EP | 0106289 | * | 5/1984 |
| JP | 2002233696 | * | 8/2002 |

* cited by examiner

CLOTHES TREATMENT APPARATUS AND METHOD FOR CONTROLLING A CLOTHES TREATMENT APPARATUS

CROSS-REFERENCE TO RELATED APPLICATION(S)

This application claims priority to Korean Patent Application No. 10-2011-0104391, filed on Oct. 13, 2011, and No. 10-2011-0108097, filed on Oct. 21, 2011, which are hereby incorporated by reference as if fully set forth herein.

BACKGROUND

1. Field

A clothes treatment apparatus and a method for controlling a clothes treatment apparatus are disclosed herein.

2. Background

Clothes treatment apparatuses are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
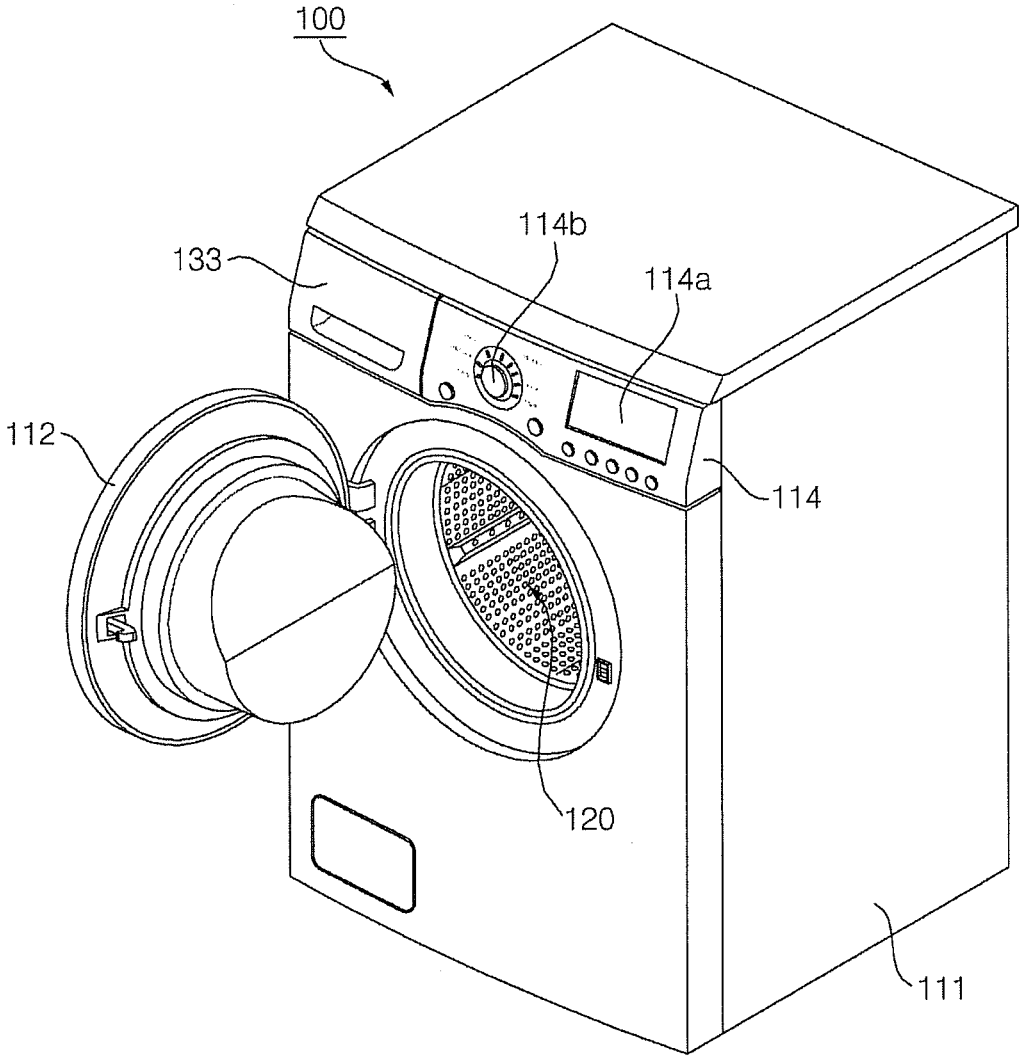
FIG. 1 is a front perspective view of a clothes treatment apparatus according to an embodiment.

Clothes treatment apparatuses may include a dedicated drying apparatus having only a drying function and a combined drying and washing apparatus having clothes drying and washing functions. Based on a structure and shape thereof, there are a drum type clothes treatment apparatus that dries clothes by tumbling the clothes using a rotatable drum, and a so-called cabinet type clothes treatment apparatus that dries clothes on hangers.

In general, a conventional combined drying and washing apparatus may include a tub in which wash water is received. A drum, in which clothes may be placed, may be rotatably installed in the tub. The drum may be connected to a rotating shaft, and a motor may be used to rotate the rotating shaft. The rotating shaft may be rotatably supported by a bearing housing, that is, in turn, installed at a rear wall of the tub. The tub may be connected to a suspension device that absorbs vibration of the drum and the tub.

A washing apparatus generally performs a series of clothes washing, rinsing, and dehydration cycles, for example, to remove contaminants adhered to clothes or other items (hereinafter, referred to as cloth), using water and detergent and via mechanical operation. There are basically three types: an agitator type washing apparatus, a pulsator type washing apparatus, and a drum type washing apparatus.

The agitator type washing apparatus performs washing via clockwise and counterclockwise rotation of a wash rod erected at a center of a wash tub. The pulsator type washing apparatus performs washing using friction between cloth and a water current caused via clockwise and counterclockwise rotation of a disc shaped rotor blade provided at a bottom of a wash tub. The drum type washing machine performs washing via rotation of a drum in which water, detergent, and cloth are received.

For treatment of cloth using the aforementioned clothes treatment apparatuses, the need to reduce required time and electric power is high.

The combined drying and washing apparatus may include a cabinet that defines a receiving space therein; a tub disposed in the cabinet; a drum rotatably installed in the tub; a condensing duct provided outside of the tub, that allows air containing moisture drawn from the tub to be condensed; a drying duct connected to a downstream side of the condensing duct in an air flow direction, that heats air and feeds the heated air into the tub; and a circulation fan that circulates air from the tub through the condensing duct and the drying duct.

With the above-described combined drying and washing apparatus, upon drying of laundry, air moved by a blower is heated by a heater provided in the drying duct, and in turn, the heated air (hot air) is fed into the tub to enable drying of laundry via rotation of the drum and using the hot air. Thereafter, the hot air, used to dry the laundry, is changed into wet air due to moisture emitted from the dried laundry, and then is directed from the tub to the condensing duct where moisture contained in the air is removed. The resulting air, having had the moisture removed therefrom, is again circulated into the drying duct via the blower.

During the drying of laundry as described above, lint contained in laundry may be introduced into the condensing duct along with the hot air, and may remain in the condensing duct, the blower, the drying duct. The lint remaining in the condensing duct may reduce efficiency of the condensing duct, and the lint remaining in the blower may cause failure of the blower. Moreover, the lint remaining in the drying duct may cause failure or fire of the heater provided in the drying duct.

For this reason, there is a need for a filter that filters lint contained in the hot air introduced into the condensing duct, and maintenance of the filter is also an important challenge.

Figure 2:
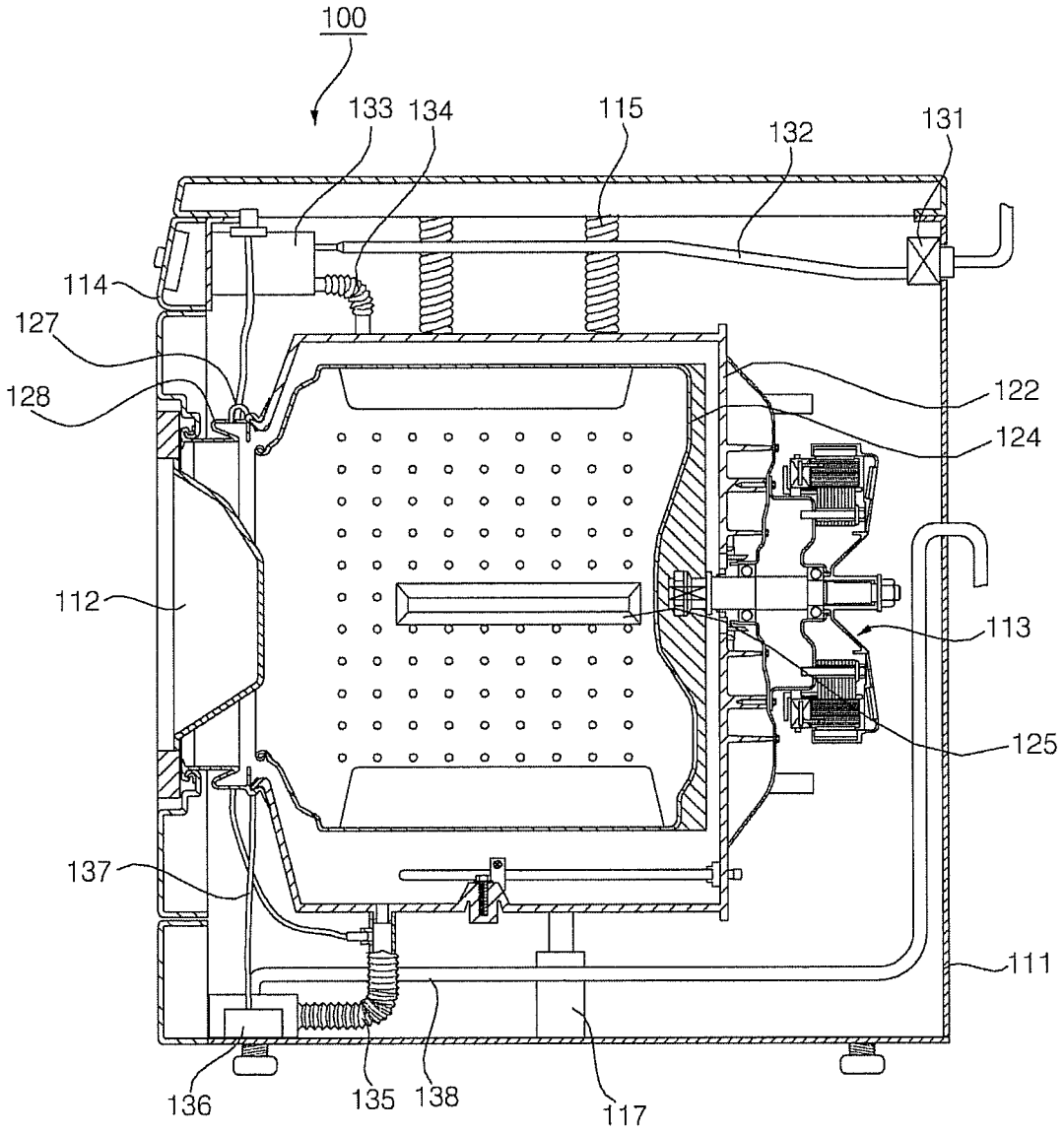
FIG. 2 is a sectional view of the clothes treatment apparatus of FIG. 1.

FIG. 1 is a front perspective view of a clothes treatment apparatus according to an embodiment. FIG. 2 is a sectional view of the clothes treatment apparatus of FIG. 1.

The clothes treatment apparatus 100 according to this embodiment may include a cabinet 111, which may define an external appearance of the clothes treatment apparatus 100; a door 112 that opens or closes one side of the cabinet 111 to allow cloth to be placed into or removed from the cabinet 111; a tub 122 disposed in the cabinet 111, which may be supported by the cabinet 111; a drum 124 disposed in the tub 122 and which is rotatable; a drive 113 that rotates the drum 124 by applying a torque thereto; a detergent box 133 in which detergent may be received; and a control panel 114 that functions to receive a user input and display operating states of the clothes treatment apparatus 100.

The cabinet 111 may have a cloth entrance/exit opening 120 to enable cloth to be placed into and removed from the cabinet 111. The door 112 may be pivotally coupled to the cabinet 111 to open or close the cloth entrance/exit opening 120. The control panel 114 may be provided separate from the cabinet and attached thereto, or may be integrated with the cabinet 111. The detergent box 133 may be slidably mounted to the cabinet 111 so as to be pulled out or pushed into the cabinet 111.

The tub 122 may be placed in the cabinet 111 in a shock absorbable manner using one or more spring(s) 115 and one or more damper(s) 117. The tub 122 may be configured to receive wash water therein. The drum 124 may be disposed in the tub 122.

The drum 124 may be rotatable, and may have a plurality of through-holes that permit passage of wash water therethrough. One or more lifters 125 may be arranged on an inner wall surface of the drum 124 to lift cloth to a predetermined height during rotation of the drum 124. The drum 124 may be rotated upon receiving rotational power from the drive 113.

A gasket 128 may serve as a seal between the tub 122 and the cabinet 111. The gasket 128 may be located between an entrance of the tub 122 and the cloth entrance/exit opening 120. The gasket 128 may serve, not only to alleviate shock that would otherwise be transmitted to the door 112 during rotation of the drum 124, but also to prevent leakage of wash water from the tub 122. A circulating nozzle 127 may be provided at or adjacent the gasket 128 to direct wash water into the drum 124.

The drive 113 may enable rotation of the drum 124. The drive 113 may rotate the drum 124 at various speeds or in different directions. The drive 113 may include, for example, a motor, a switching device that controls the motor, and a clutch.

The detergent box 133 may be configured to receive detergent, including wash detergent, fabric softener, or bleach, for example. The detergent box 113 may be slidably pulled out and pushed into a front surface of the cabinet 111. The detergent may be mixed with wash water fed into the detergent box 133, and then introduced into the tub 122.

A water supply valve 131 may be provided in the cabinet 111, that controls introduction of wash water from an external water source, along with a water supply hose 132, through which wash water introduced via the water supply valve 131 may flow to the detergent box 133, and a water supply pipe 134, through which wash water mixed with the detergent in the detergent box 133 may be introduced into the tub 122.

A drain pipe 135 may be provided in the cabinet 111, through which wash water may be discharged from the tub 122, along with a pump 136 that enables discharge of wash water from the tub 122, a circulating hose 137 that circulates wash water, the circulating nozzle 127, through which wash water may be introduced into the drum 124, and a drain hose 138 through which wash water may be discharged to the outside. According to embodiments, the pump 136 may include a circulating pump and a drain pump, which may be, respectively, connected to the circulating hose 137 and the drain hose 138.

The control panel 114 may include an input **114*b* that receives various operating commands, related to, for example, selection of a wash course, an operating time on a per cycle basis, and reservation, from a user, and a display 114*a* that displays operating states of the clothes treatment apparatus 100**.

Embodiments disclosed herein allow laundry put into the drum 124 to be dried by dry hot air. A drying device (1200, see FIG. 4) may be provided outside of the tub 122 so as to communicate with an interior of the tub 122. The drying device 1200 will be described hereinbelow.

Clothes treatment courses may include, for example, a standard course, a lingerie/wool course, a boiling course, a speed wash course, a functional clothes course, and a silent course, based on a kind or function of cloth. Operation of the clothes treatment apparatus may be basically divided into a washing cycle and a drying cycle, and in turn, each cycle may be realized via repetitive or sequential implementation of water supply, washing, rinsing, drainage, dehydration, and/or drying operations, for example.

Figure 3:
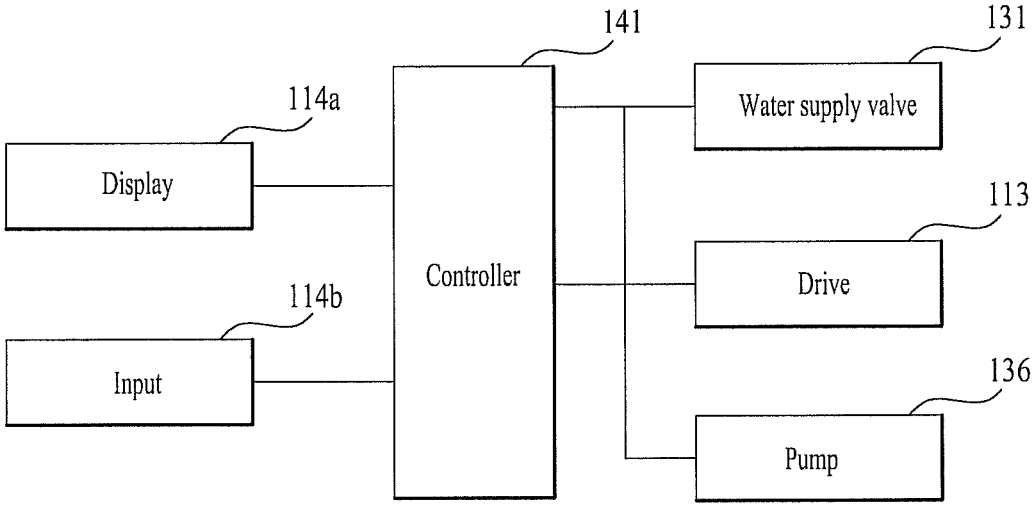
FIG. 3 is a block diagram of the clothes treatment apparatus of FIG.

FIG. 3 is a block diagram of the clothes treatment apparatus of FIG. 1. A controller 141 may control overall operations of the clothes treatment apparatus 100 in response to an operating command input to the input **114*b*. The controller 141 may be integrated with the control panel 114, and may include a microcomputer that controls operations of the clothes treatment apparatus 100, and other electronic components. The controller 141 may determine whether to perform the washing cycle and/or the drying cycle, or to perform water supply, washing, rinsing, drainage, dehydration, and/or drying operations of each cycle based on a wash course selected by the user, and may also determine, for example, a time and repetition number of each operation, and control implementation thereof. According to this embodiment, the controller 141 may control the water supply valve 131, the drive 113, and the pump 136** based on a selected course or in response to various operating commands.

Figure 4:
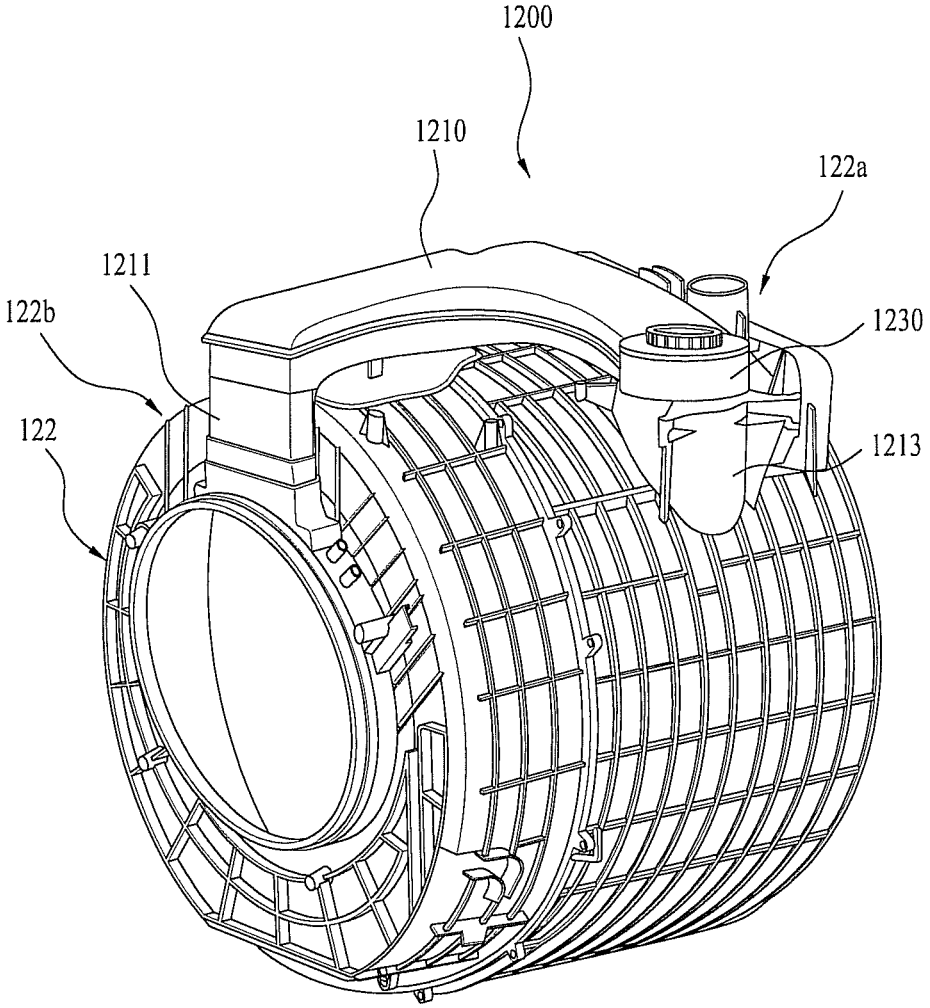
FIG. 4 is a front perspective view of a drying device and a tub of the clothes treatment apparatus of FIG. 1.

Hereinafter, a drying device of a clothes treatment apparatus according to embodiments will be described with reference to FIGS. 4 to 8. Referring to FIG. 4, the drying device 1200 may include a drying duct 1210, through which interior air of the drum 124 may circulate; a blower fan 1230, which may be located in the drying duct 1210 to circulate interior air of the drying duct 1210; and a filter 1250, which may be located at a leading end of the blower fan 1230 to remove lint from air passing through the blower fan 1230.

Ends of the drying duct 1210 may be connected to a first side **122*a* and a second side 122*b* of the tub 122. The first side 122*a* of the tub 122 may be an outer peripheral surface of the tub 122, and more particularly, may be an upper region of the outer peripheral surface. The second side 122*b* of the tub 122 may be a front surface of the tub 122, and more particularly, may be an upper region of the front surface. That is, a first end 1211 of the drying duct 1210 may be connected to the front surface of the tub 122 and the second end 1213 may be connected to a lateral position of the outer peripheral surface of the tub 122, such that circulation of interior air of the tub 122 may be realized as the air moves from the second end 1213 to the first end 1211 through the drying duct 1210. The first end 1211 of the drying duct 1210 may be connected to the second side 122*b* of the tub 122 and the second end 1213 may be connected to the first side 122*a* of the tub 122. As such, if interior air of the tub 122 is directed to the first side 122*a*, for example, to the outer peripheral surface of the tub 122, the air may be fed to the second side 122*b*, for example, to the front surface of the tub 122 by passing through the drying duct 1210**.

The blower fan 1230 may be located in the drying duct 1210 to circulate interior air of the drying duct 1210. More specifically, the blower fan 1230 may allow interior air of the tub 122 to be suctioned to the second end 1213 of the drying duct 1210, and then discharged from the first end 1211 of the drying duct 1210. Hereinafter, for convenience of explanation, an air flow direction from the second end 1213 to the first end 1211 of the drying duct 1210 may be referred to as a first direction. That is, the first direction corresponds to an air flow direction from the first side 122*a* to the second side 122*b* of the tub 122.

Figure 5:
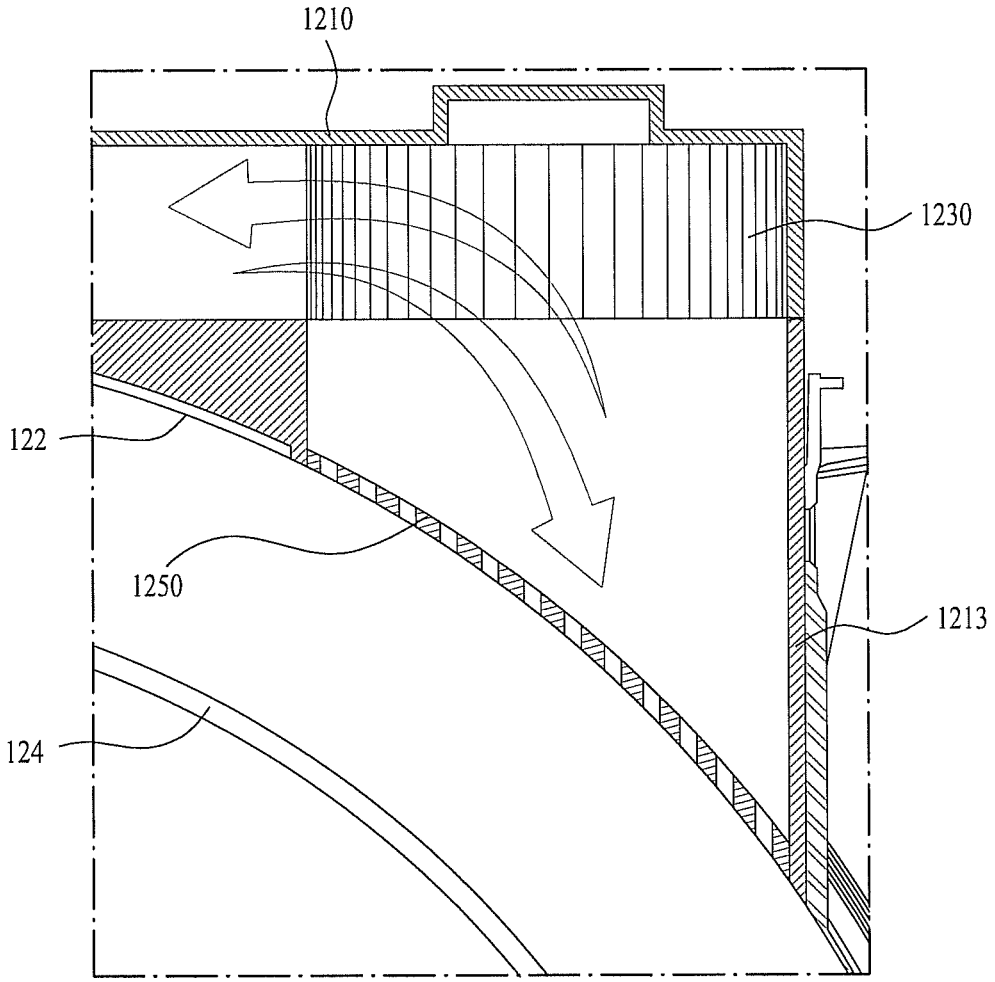
FIG. 5 is a side sectional view showing a filter and drying duct of a drying device according to an embodiment.

The blower fan 1230 may be an axial fan that blows forwardly introduced air rearward, or may be a sirocco fan that blows forwardly introduced air laterally, as shown in FIG. 5. FIG. 5 shows the drying device 1200 in sectional view, with the filter 1250 aligned on the outer peripheral surface of the tub 122 adjacent an inner surface of the second end 1213 of the drying duct 1210. More specifically, the filter 1250 may be provided toward the first side 122*a* of the tub 122 where the drying duct 1210 may be connected to the tub 122.

The filter 1250 may remove lint from air circulating through the drying duct 1210. The filter 1250 may be, for example, a mesh. The filter 1250 may be located near the first side 122*a* of the tub 122, and more particularly, may be located at the first side 122*a* of the tub 122. That is, the filter 1250 may be located in the drying duct 1210 near the first side 122*a* of the tub 122, or may be located at the first side 122*a* where the drying duct 1210 is connected to the tub 122. To prevent lint contained in laundry or cloth from entering the drying device 1200 along with hot air upon drying of laundry or cloth, the filter 1250 may be located close to the second end 1213 of the drying duct 1210.

If lint remains in the drying duct 1210 and the blower fan 1230, for example, the lint remaining in the blower fan 1230 may cause failure of the blower fan 1230 and malfunction of a heater (1260, see FIG. 8) that heats interior air of the drying duct 1210. The filter 1250 may serve to eliminate this problem.

However, if a large amount of lint is caught by the filter 1250 after extensive operation, this may deteriorate a circulation rate of air passing through the drying device 1200. Thus, it is necessary to remove the lint adhered to the filter 1250 for the purpose of efficient air circulation. As noted, since the filter 1250 is located inside the tub 122, a user cannot separate and clean the filter 1250, and removal of the lint completely depends on a self-maintenance ability of the clothes treatment apparatus.

When the blower fan 1230 is driven for the drying cycle, air moves through the drying duct 1210 in the first direction. To remove lint caught by the filter 1250, air may be blown in a second direction opposite to a normal air flow direction (the first air flow direction), which may allow lint remaining on the filter 1250 to be separated by air pressure.

FIG. 5 is a side sectional view of a filter and drying duct of a drying device according to an embodiment. When it is desired to clean the filter 1250, a rotation direction of the blower fan 1230 may be reversed to switch an air blowing direction from a normal air flow direction, that is, the first direction, to a second direction opposite to the first direction. Alternatively, where appropriate, the air flow direction may be reversed via a change in shape or arrangement of blades of the fan. More specifically, according to the embodiment shown in FIG. 5, to change the flow direction of air passing through the filter 1250 from the first direction to the second direction, the rotation direction of the blower fan 1230 may be reversed, enabling all air passing through the drying duct 1210 to move in the second direction.

Figure 6:
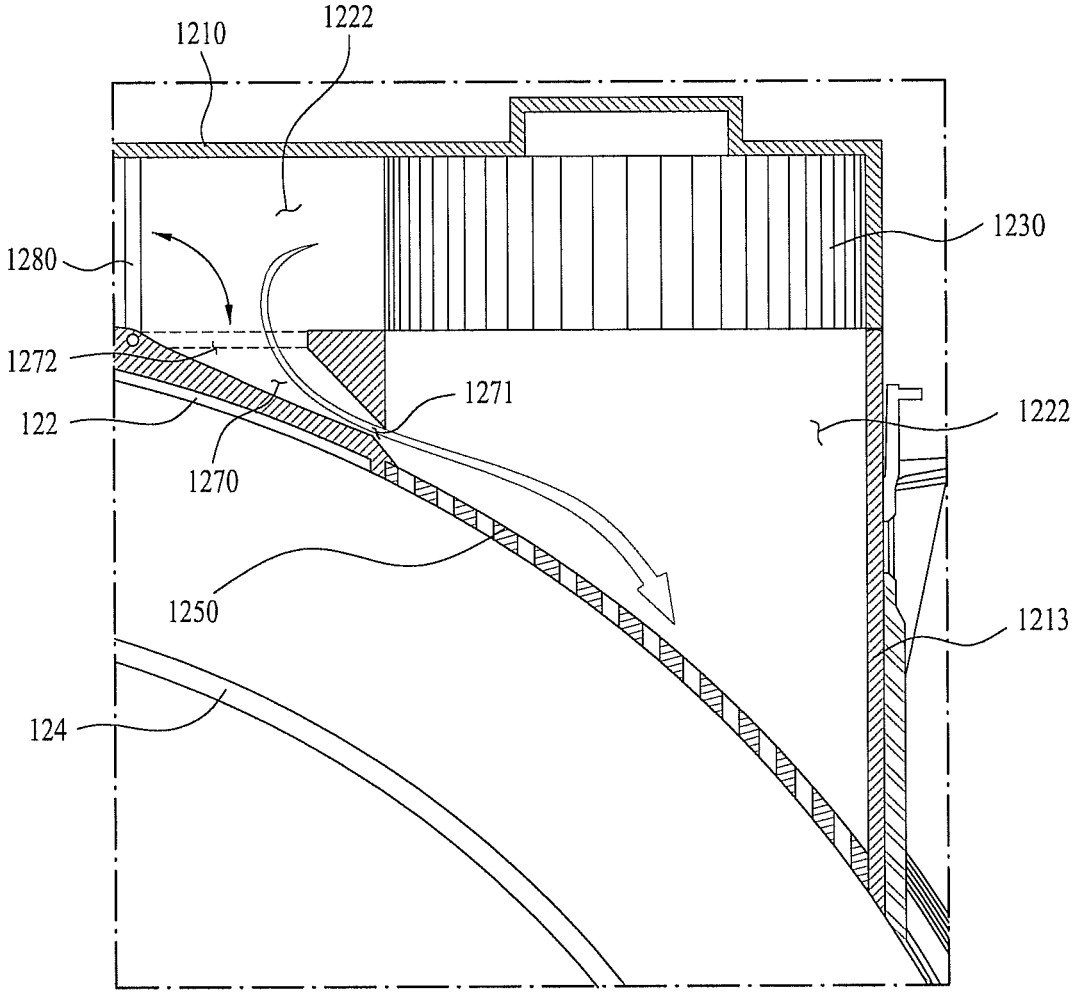
FIG. 6 is a side sectional view of a filter and a drying duct of a drying device according to another embodiment.
Figure 7:
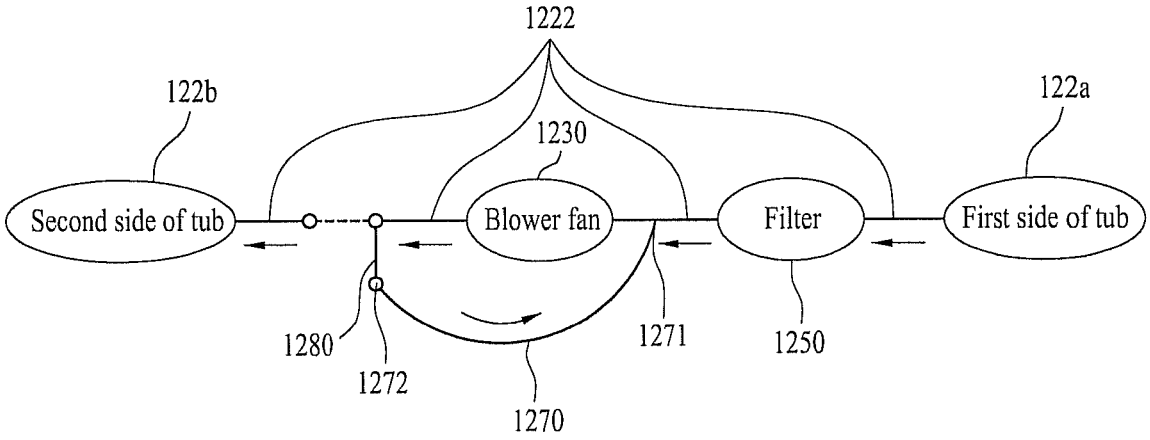
FIG. 7 is a diagram schematically illustrating a flow path through a tub and a drying device according to an embodiment.

FIG. 6 is a side sectional view of a filter and a drying duct of a drying device according to another embodiment, while FIG. 7 is a diagram schematically illustrating a flow path through a tub and a drying device according to an embodiment. Unlike the embodiment of FIG. 5, this embodiment changes the air flow direction using a separate flow path, instead of changing the air flow direction using a fan. That is, drying device 1200 of FIGS. 6 and 7 may include a bypass 1270 and a switching device 1280 near the blower fan 1230 in the drying duct 1210.

With this embodiment, the drying duct 1210 may include a main path 1222 and the bypass 1270. The main path 1222 may extend through the filter 1250 and the blower fan 1230 and to the second side 122*b* of the tub 122. As such, air moving along the main path 1222 may be air discharged from the first side 122*a* of the tub 122, may pass through the filter 1250 and the blower fan 1230, and may be introduced to the second side 122*a* of the tub 122.

The bypass 1270 may have a first end 1271 connected to the main path 1222 between the filter 1250 and the blower fan 1230, and a second end 1272 connected to the main path 1222 between the blower fan 1230 and the second side 122*b* of the tub 122. That is, the bypass 1270 may provide a flow path to redirect air around the blower fan 1230. The switching device 1280 may selectively guide air introduced into the drying duct 1210 to the bypass 1270 or to the second side 122*b* of the tub 122.

The switching device 1280 may be located at a position where the second end 1272 of the bypass 1270 is connected to the main path 1222. The switching device 1280 may close the bypass 1270 simultaneously with opening of the main path 1222 between the blower fan 1230 and the second end 122*b* of the tub 122, or open the bypass 1270 simultaneously with closing the main path 1222 between the blower fan 1230 and the second side 122*b* of the tub 122. As such, when the switching device 1280 closes the bypass 1270, air may pass through the blower fan 1230 and be directed to the second side 122*b* of the tub 122. When the switching device 1280 opens the bypass 1270 and closes the main path 1222 between the blower fan 1230 and the second end 122*b* of the tub 122, air may be introduced into the second end 1272 of the bypass 1270 after passing through the blower fan 1230, and then be discharged from the first end 1271 of the bypass 1270. In this case, the first end 1271 of the bypass 1270 may be oriented to face the filter 1250.

Referring to FIG. 6, the second end 1272 of the bypass 1270 may be connected to the drying duct 1210 at a rear end of the blower fan 1230, and the first end 1271 of the bypass 1270 may be connected to the other end 1213 of the drying duct 1210 at a rear end of the filter 1250. When it is desired to clean the filter 1250, air blown by the blower fan 1230 may be redirected back to the filter 1250 through the bypass 1270. As the bypass 1270 allows air to be redirected to the filter 1250 in the second direction opposite to the first direction, that is, the normal flow direction of air passing through the filter 1250, lint of the filter 1250 may be removed.

When increasing the pressure of air discharged from the first end 1271 beyond the pressure of air introduced into the second end 1272 of the bypass 1270, air may be blown in the second direction by a higher pressure than that of the flow of air flowing in the first direction. A pressure differential may be created when an area of the second end 1272 of the bypass 1270 is greater than an area of the first end 1271, as shown in FIG. 6. That is, it is desirable that the area of the second end 1272 of the bypass 1270 be greater than the area of the first end 1271.

To ensure that air is directly fed to the filter 1250, the first end 1271 of the bypass 1270 may extend to face the filter 1250. Also, the first end 1271 may be divided to form multiple apertures, through which air may be selectively fed, which may allow air to be fed to individual portions of the filter 1250.

The switching device 1280 may be adapted to selectively open or close the second end 1272 of the bypass 1270 and the drying duct 1210, as shown in FIG. 6, in order to selectively feed air to the bypass 1270 or the drying duct 1210. That is, the switching device 1280 may selectively open or close the main path 1222 between the blower fan 1230 and the second side 122*b* of the tub 122 and the second end 1272 of the bypass 1270.

Normally, to circulate air through the drying duct 1210 for drying, the second end 1272 of the bypass 1270 may be closed and the main path 1222 of the drying duct 1210 open. In contrast, when it is desired to clean the filter 1250 which is clogged, the switching device 1280 may temporarily close the main path 1222 between the blower fan 1230 and the second side 122*b* of the tub 122, allowing air that would otherwise be fed to the second side 122*b* of the tub 122 to be redirected back to the filter 1250 through the bypass 1270, so as to remove lint from the filter 1250.

Figure 8:
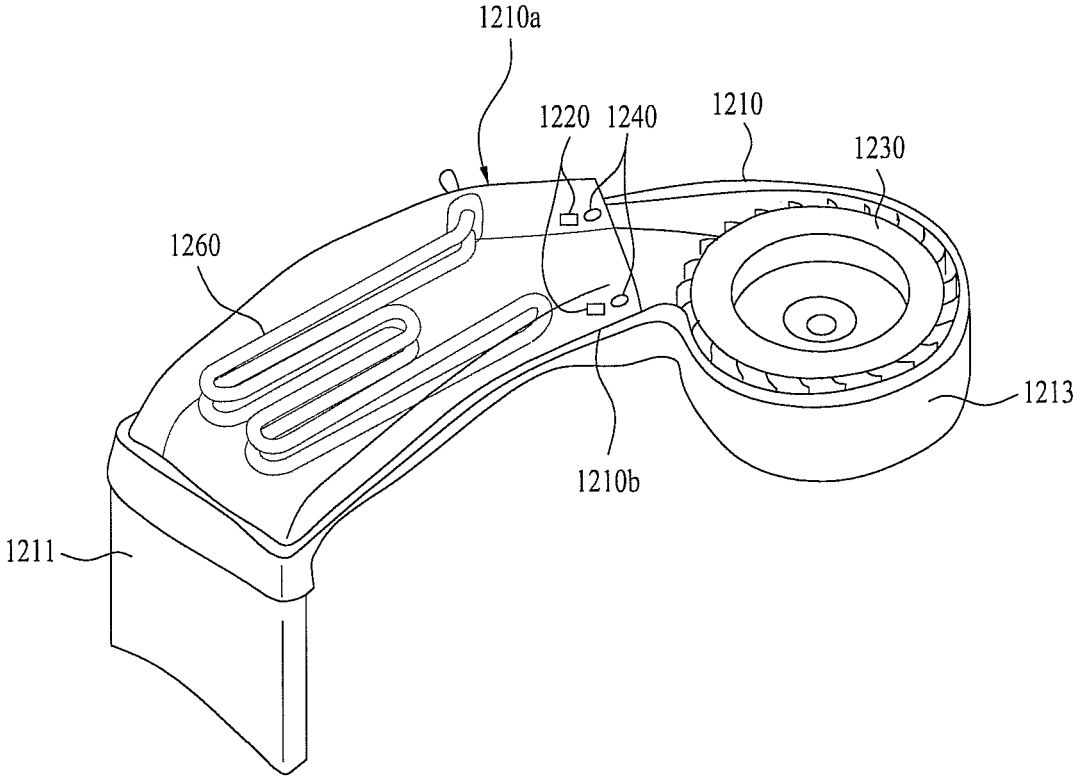
FIG. 8 is a perspective view of a drying duct of the clothes treatment apparatus of FIG. 1.

FIG. 8 is a perspective view of a drying duct of the clothes treatment apparatus of FIG. 1. Assuming that the blower fan 1230 is a sirocco fan, the blower fan 1230 may blow forwardly introduced air laterally, causing air to deviate laterally, rather than being uniformly fed throughout the drying duct 1210. This may cause temperature and pressure differentials of air between left and right sides of the drying duct 1210. These temperature and pressure differentials remarkably appear when the filter 1250 is clogged, thus causing a reduction in the amount of air passing through the filter 1250.

Whether the flow of air is smooth may be determined based on the temperature and pressure differentials. Referring to FIG. 8, the drying duct 1210 may include, for example, a pair of temperature sensors 1220 and/or a pair of pressure sensors 1240, which may be arranged at left and right sides of the drying duct 1210 between the first end 1211 and the second end 1213 of the drying duct 1210. More particularly, the pair of temperature sensors 1220 and/or pressure sensors 1240 may be located between the blower fan 1230 and the second side 122*b* of the tub 122. The pair of temperature sensors 1220 and/or the pair of pressure sensors 1240 may be arranged at opposite sides of the drying duct 1210 to detect a temperature differential and/or a pressure differential of air, respectively, at left and right sides of the drying duct 1210. The pair of temperature sensors 1220 and/or the pair of pressure sensors 1240 may be provided, respectively, at opposite edges of the drying duct 1210. More specifically, the pair of temperature sensors 1220 and/or the pair of pressure sensors 1240 may be aligned transversal to the flow of air within the drying duct 1210. Thus, the pair of temperature sensors 1220 and/or the pair of pressure sensors 1240 may be arranged, respectively, at or adjacent first and second edges 1210*a*, 1210*b* within the drying duct 1210. As such, one of the pair of temperature sensors 1220 and/or the pair of pressure sensors 1240 may serve to measure the temperature or pressure, respectively, of air moving along the first edge 1210*a* within the drying duct 1210, and the other one may serve to measure the temperature or pressure, respectively, of air moving along the second edge 1210*b* within the drying duct 1210.

If a temperature differential sensed by the pair of temperature sensors 1220 increases above a predetermined temperature reference value T0, or if a pressure differential sensed by the pair of pressure sensors 1240 increases above a predetermined pressure reference value P0, it may be judged that the filter 1250 is clogged. The temperature reference value T0 and the pressure reference value P0 may be experimentally determined. Exceeding the temperature reference value T0 and the pressure reference value P0 may denote that the temperature and pressure of air has reached critical values that cannot ensure smooth flow of air passing through the drying duct 1210.

The controller 141 may control operation of the blower fan 1230 and/or the switching device 1280. When the filter 1250 is clogged, the controller 141 may control the switching device 1280 and/or the blower fan 1230 to blow air to the bypass 1270, and/or change a rotation direction of the blower fan 1230 to change the air flow direction.

The controller 141 may judge whether the filter 1250 is clogged based on data related to the temperature and/or pressure of air sensed by the pair of temperature sensors 1220 and/or the pair of pressure sensors 1240, respectively. More specifically, the controller 141 may judge whether the filter 1250 is clogged by comparing a temperature differential sensed by the pair of temperature sensors 1220 with the temperature reference value T0, and/or by comparing a pressure differential sensed by the pressure sensors 1240 with the pair of pressure reference value P0.

Alternatively, the controller 141 may judge whether the filter 1250 is clogged based on revolutions per minute of the blower fan 1230. Higher revolutions per minute may denote a reduction in resistance due to a smaller amount of air passing through the blower fan 1230, and thus it is judged that the filter 1250 is clogged.

Hereinafter, methods for controlling a clothes treatment apparatus according to embodiments will be described hereinbelow. The methods may be implemented using a clothes treatment apparatus, such as that discussed above with respect to FIGS. 1-8; however, embodiments are not so limited.

Figure 9:
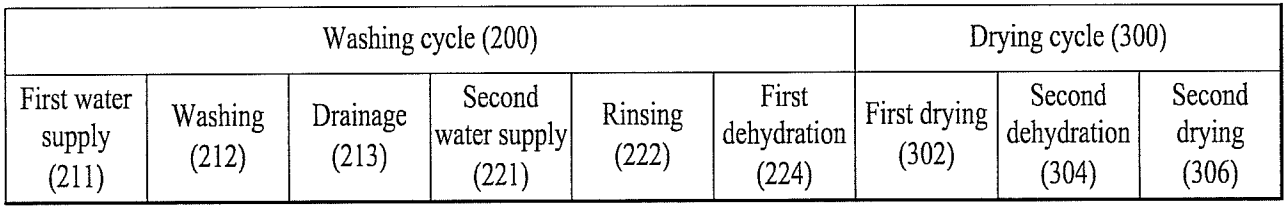
FIG. 9 is a chart illustrating cycles of a method for controlling a clothes treatment apparatus according to an embodiment.

FIG. 9 is a chart illustrating cycles of a method for controlling a clothes treatment apparatus according to an embodiment. The method may include a washing cycle 200 for washing clothes or other items (i.e., cloth), and a drying cycle 300 for drying the clothes or other items (i.e., cloth) subjected to the washing cycle 200. The drying cycle 300 may be performed immediately after completion of the washing cycle 200.

An implementation time of the washing cycle 200 may be less than an implementation time of the drying cycle 300. Normally, in a case of treating a small amount of clothes or other items, or treating clothes or other items having a low contamination level, a reduced treatment time may be required in comparison to a case of treating a large amount of clothes or other items, or clothes or other items having a high contamination level. This is because the small amount of clothes or other items having the low contamination level may be easily and thoroughly cleaned with a reduced amount of detergent or time.

However, it is difficult to reduce the time taken for the drying cycle 300, even in the case of a small amount of clothes or other items. This is because the clothes or other items hold moisture during implementation of the washing cycle 200, and removing the moisture and drying the clothes or other items requires a predetermined amount of time or more.

Accordingly, embodiments disclosed herein may achieve a reduction in the entire clothes treatment time by reducing a time taken for the washing cycle 200. This is because sufficient removal of contaminants from a small amount of clothes or other items may be accomplished even if the time taken for the washing cycle 200 is reduced.

The time taken for clothes treatment according to one embodiment may be less than approximately 1 hour, such that the washing cycle 200 takes approximately 15 minutes and the drying cycle 300 takes approximately 45 minutes. Generally, the washing cycle 200 may take one third the time taken for the drying cycle 300, which may result in reduced electric power consumption.

In the washing cycle 200, after cloth is dipped in wash water mixed with detergent, a drum, such as drum 124 discussed above with respect to the embodiments of FIGS. 1-8, may be rotated to remove contaminants from the cloth, and subsequently rinsing and dehydration may be performed. In general, the washing cycle 200 may include a washing operation 212 for washing clothes or other items, a rinsing operation 222 for rinsing the clothes or other items, and a first dehydration operation 224 for removing water from the clothes or other items.

In the method for controlling a clothes treatment apparatus according to embodiments, the washing cycle 200 may be initially progressed in a sequence of a first water supply operation 211, the washing operation 212, and a drainage operation 213. When the washing cycle 200 begins, a controller, such as controller 141 discussed above with respect to the embodiments of FIGS. 1-8, may control a display, such as display 114*a* discussed above with respect to the embodiments of FIGS. 1-8, to display a washing icon for notifying commencement of the washing cycle 200.

The first water supply operation 211 may involve supplying wash water from an external water source into a tub, such as tub 122 discussed above with respect to the embodiments of FIGS. 1-8. During the first water supply operation 211, the controller may open a water supply valve, such as water supply valve 131 discussed above with respect to the embodiments of FIGS. 1-8, causing wash water supplied from the external water source to move through a water supply hose and into a detergent box, such as water supply hose 132 and detergent box 133 discussed above with respect to the embodiments of FIGS. 1-8. The wash water may be mixed with detergent in the detergent box, and then may be introduced into the tub through a water supply pipe, such as water supply pipe 134 discussed above with respect to the embodiments of FIGS. 1-8. The wash water may be mixed with bleach in the detergent box.

To ensure that clothes or other items are uniformly wetted with the wash water mixed with detergent, during the first water supply operation 211, the controller 141 may operate a drive, such as drive 113 discussed above with respect to the embodiments of FIGS. 1-8, to enable wetting of clothes or other items via rotation of the drum. The first water supply operation 211 may be performed until the wash water is filled to a target water level. The controller may determine the target water level based on an amount of cloth measured before the first water supply operation 211, or based on a selected wash course.

The level of wash water may be measured using a water level sensing device (not shown). The amount of cloth may be measured via various methods. With this embodiment, the level of wash water may be measured by rotating the drum at a predetermined speed for a predetermined period of time by the drive, and thereafter measuring deceleration time of the drum by the controller. A greater deceleration time of the drum may denote a greater amount of cloth. After the wash water is introduced into the tub up to the target water level, the controller may close the water supply valve, completing the first water supply operation 211.

The washing operation 212 may involve rotating the drum in which the clothes or other items wetted with the wash water mixed with detergent may be received. During the washing operation 212, the controller may drive the drive to rotate the drum at various speeds or in various directions, which may apply a bending force, friction, and impact, for example, to the cloth, enabling removal of contaminants from the cloth. The controller may control the drive to intermittently rest at an interval of several seconds to several minutes, in order to prevent overheating of the drive during the washing cycle 212.

Based on a wash course or user selection, steam may be ejected into the drum during the washing operation 212. During the washing operation 212, the controller may operate a pump, such as pump 136 discussed above with respect to the embodiments of FIGS. 1-8, to circulate the wash water through a circulating hose, such as circulating hose 137 discussed above with respect to the embodiments of FIGS. 1-8, allowing the wash water to be introduced into the drum through a circulating nozzle, such as circulating nozzle 127 discussed above with respect to the embodiments of FIGS. 1-8.

The drainage operation 213 may involve discharging the wash water from the tub to the outside of a cabinet, such as cabinet 111 discussed above with respect to the embodiments of FIGS. 1-8. During the drainage operation 213, the controller may operate the pump to discharge the wash water in the tub to the outside through a drain hose, such as drain hose 138 discussed above with respect to the embodiments of FIGS. 1-8.

When a second water supply operation 221 begins, the controller may control the display to display a rinsing icon. Similar to the above described first water supply operation 211, the second water supply operation 221 may involve supplying wash water from an external water source into the tub. During the second water supply operation 221, the controller may open the water supply valve, causing the wash water supplied from the external water source to be introduced into the tub through the water supply hose and the water supply pipe. During the second water supply operation 221, fabric softener may not be mixed with the wash water. Rather, fabric softer may be mixed with the wash water during a final water supply of the rinsing operation 222, which will be described hereinafter. To ensure that clothes or other items are uniformly wetted with the wash water, the controller may operate the drive to enable wetting of clothes or other items via rotation of the drum.

In particular, it may be desirable to supply warm water during the second water supply operation 221. Since warm water has a higher temperature than a normal temperature, wetting cloth with warm water may ensure that the temperature of cloth is raised to be equal to the temperature of the warm water. That is, in a case in which the drying cycle 300 successively follows the washing cycle 200, the interior temperature of the drum may be raised within a reduced time when feeding hot air to the cloth, as the temperature of has been raised to be equal to the temperature of the warm water, in comparison to feeding hot air to cloth, which has been rinsed with cold water. As such, the time taken for clothes treatment may be reduced.

The rinsing operation 222 may involve dipping cloth in wash water mixed with fabric softener, and thereafter rotating the drum to remove residual detergent from the cloth. During the rinsing operation 222, the controller may control the drive to rotate the drum at various speeds or in various directions, which may apply a bending force, friction, and impact, for example, to the cloth, enabling removal of residual detergent and contaminants from the cloth. The controller may operate the pump during the rinsing operation 222, to enable the wash water to circulate through the circulating hose and be introduced into the drum through the circulating nozzle.

The first dehydration operation 224 may involve dehydrating the cloth by rotating the drum at a high speed. When the first dehydration operation 224 begins, the controller may control the display to display a dehydration icon for notifying commencement of dehydration.

The first dehydration operation 224 may involve rotating the drum at a high speed sufficient to allow the wash water to be extracted from the cloth. During the first dehydration operation 224, as the controller drives the drive to rotate the drum at a high speed, the cloth may be rotated while being adhered to an inner wall surface of the drum, thereby being dehydrated by centrifugal force. Since the first dehydration operation 224 should not completely dry the cloth, the drum may be rotated at approximately 108 rpms, a speed sufficient to ensure that the cloth is rotated while being adhered to the inner wall surface of the drum. During the first dehydration operation 224, the controller may intermittently operate the pump to allow the wash water in the tub to be discharged to the outside through the drain hose.

The first dehydration operation 224 may involve rotating clothes or other items to extract moisture contained in the clothes or other items. Unlike the above description, more specifically, the first dehydration operation 224 may include, for example, drainage, cloth spreading, main dehydration, and cloth disentangling. Drainage may involve discharging the wash water in the tub to the outside of the cabinet similar to the above described drainage operation 213 of the washing cycle 200. Cloth spreading may involve spreading cloth by repeating acceleration and deceleration of the drum. During washing or rinsing, for example, cloth tends to collect on one side due to entangling of cloth, which causes eccentricity of the drum on that one side of the drum which exhibits a greater weight. When the controller decelerates the drum during cloth spreading, the controller may measure the amount of cloth based on a deceleration time of the drum, and measure a degree of eccentricity based on variation of the rotation speed of the drum after accelerating the drum.

The amount of cloth may be calculated by measuring the deceleration time when the controller decelerates the drum as described above. The longer the deceleration time of the drum, the greater the amount of cloth. Alternatively, the controller may calculate the amount of cloth by measuring an acceleration time when the controller accelerates the drum.

The degree of eccentricity may be calculated based on variation of the rotational speed of the drum after acceleration of the drum. The speed of the drum may be measured, for example, using a Hall sensor, or may be calculated by measuring current applied to a motor of the drive.

The controller may judge whether the degree of eccentricity is within an allowable range based on a difference between a speed variation of the drum and a reference speed variation. The reference speed variation may depend on the amount of cloth. The controller may store a table of the degree of eccentricity with respect to the reference speed variation depending on the amount of cloth.

The controller may accelerate or decelerate the drum based on the degree of eccentricity. More specifically, the controller may adjust a rate of acceleration or deceleration of the drum based on the degree of eccentricity. The controller may stop rotation of the drum when excessive eccentricity of cloth occurs.

The controller may repeat acceleration and deceleration of the drum based on the degree of eccentricity. The controller may continuously accelerate and decelerate the drum when the degree of eccentricity exceeds an allowable limit. If the degree of eccentricity exceeds the allowable limit, and thus acceleration and deceleration of the drum are continuously repeated, the controller may stop such repetition. More specifically, if acceleration and deceleration of the drum are continuously repeated beyond an allowable number, the controller may provide the display with a signal informing of an abnormal operation, and stop rotation of the drum.

After the above described washing cycle 200 ends, the drying cycle 300 for drying clothes or other items may be performed. The drying cycle 300 may include a first drying operation 302 for raising an interior temperature of the drum by feeding hot air to clothes or other items received in the drum. In this case, feeding hot air into the drum may be accomplished via driving of a heater and a blower fan, such as heater 1260 and blower fan 1230 discussed above with respect to the embodiment of FIGS. 1-8.

After the first drying operation 302 ends, a second dehydration operation 304 may be performed. The second dehydration operation 304 may involve rotating the drum at a high speed sufficient to allow wash water contained in cloth to be extracted from the cloth. During the second dehydration operation 304, the controller may drive the drive to rotate the drum at a high speed, allowing the cloth to be rotated while being adhered to the inner wall surface of the drum, thereby being dehydrated by centrifugal force. Since the interior of the drum has already reached a high temperature via the first drying operation 302, the second dehydration operation 304 may allow the entire cloth to be exposed to the high temperature. The controller may intermittently operate the pump during the second dehydration operation 304 to allow the wash water in the tub to be discharged to the outside through the drain hose.

Subsequently, a second drying operation 306 may be performed. Similar to the first drying operation 302, during the second drying operation 306, hot air may be fed into the drum via driving of the heater and the blower fan. In the case in which warm water is fed during the second water supply operation 221 to enable rinsing of clothes or other items using the warm water, it is desirable to continuously feed hot air from the beginning to the end of the drying cycle 300 for drying the clothes or other items. That is, it is desirable that the drying cycle 300 may include only the first drying operation 302, omitting the second dehydration operation 304 and the second drying operation 306. This is because the temperatures of clothes or other items and the interior temperature of the drum have already been raised by warm water, the second dehydration operation 304, which stops feeding of hot air, may disadvantageously extend a time taken for the drying cycle 300. In other words, if the washing cycle 200 includes rinsing clothes or other items using warm water, it is desirable to continuously feed hot air to dry the clothes or other items throughout the drying cycle 300.

Figure 10:
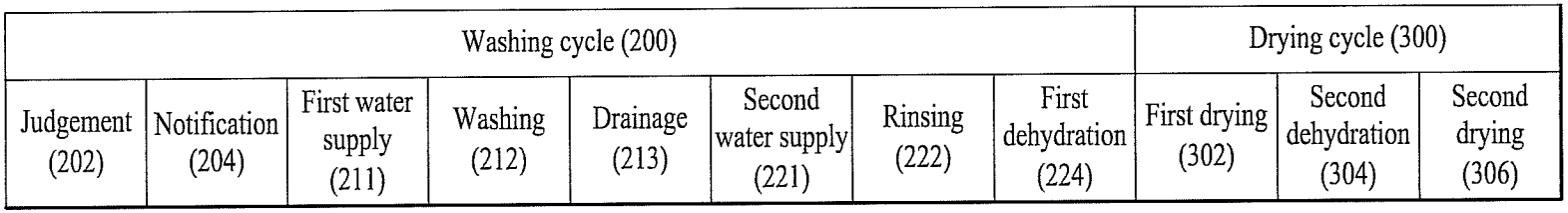
FIG. 10 is a chart illustrating cycles of a method for controlling a clothes treatment apparatus according to another embodiment.

FIG. 10 is a chart illustrating cycles of a method for controlling a clothes treatment apparatus according to another embodiment. The method may be implemented using a clothes treatment apparatus, such as that discussed above with respect to FIGS. 1-8; however, embodiments are not so limited. In FIG. 10, the washing cycle 200 initially may include a judging operation 202 for judging the amount of clothes or other items that are received in the drum 124 and need to be treated. In the judging operation 202, it may be judged whether the amount of clothes or other items is equal to or less than a preset value. A smaller amount of clothes or other items to be treated is desirable in terms of a reduction in clothes treatment time as described above.

The amount of clothes may be measured by measuring a load applied to the drum during rotation of the drum. This method for measuring the amount of clothes or other items received in the drum is well known to those skilled in the art, and a detailed description thereof will be omitted hereinafter.

In this case, the preset value may be at most about 3 lbs. Although the preset value used in the judging operation 202 may be specified by the user, the preset value may vary based on a capacity of the clothes treatment apparatus. For example, the preset value in the case of a large capacity clothes treatment apparatus is greater than that in the case of a small capacity clothes treatment apparatus. However, with embodiments disclosed herein, to reduce a time taken for clothes treatment, it may be desirable to treat a smaller amount of clothes or other items, rather than a typical treatment amount of clothes or other items.

If the amount of clothes or other items judged in the judging operation is equal to or less than the preset value, the washing cycle 200 and the drying cycle 300 may be completed within approximately 1 hour. On the other hand, if the amount of clothes or other items is greater than the preset value, a notifying operation 204 may be performed. More specifically, after it is judged in the judging operation 202 that the amount of clothes or other items is not the preset value or less, associated information may be notified to the user. This is because, if the amount of clothes or other items is greater than the preset value, a time exceeding about approximately 1 hour may be necessary to allow the user to feel that the clothes or other items are rapidly treated even if the contamination degree of clothes or other items is low. Moreover, if the user forcibly completes clothes treatment within a short time despite that the amount of clothes or other items is greater than the preset value, it may cause insufficient removal of contaminants from the clothes or other items or insufficient drying of the clothes or other items. Displaying the associated information on the display may assist the user in removing a portion of the clothes or other items from the drum based on the displayed information, and then again performing the above described judging operation 202.

Figure 11:
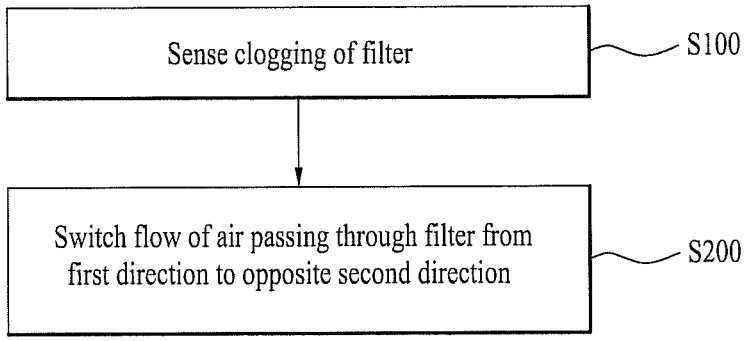
FIGS. 11 to 13 are flowcharts for methods of controlling a clothes treatment apparatus according to embodiments.
Figure 12:
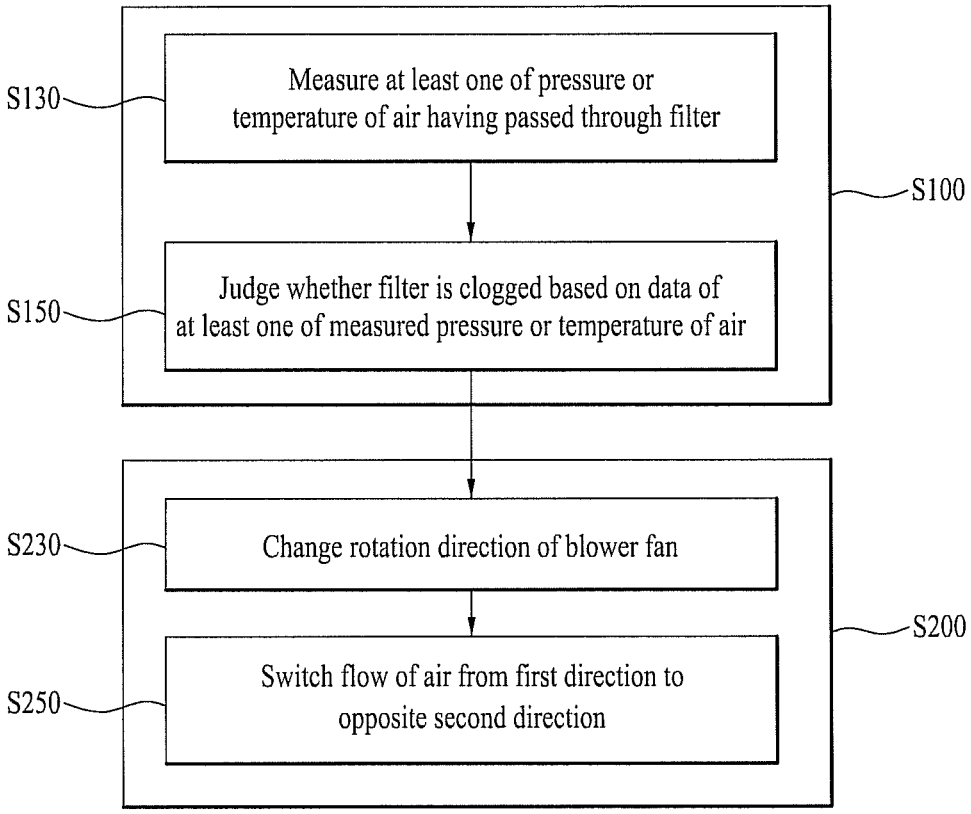
Figure 13:
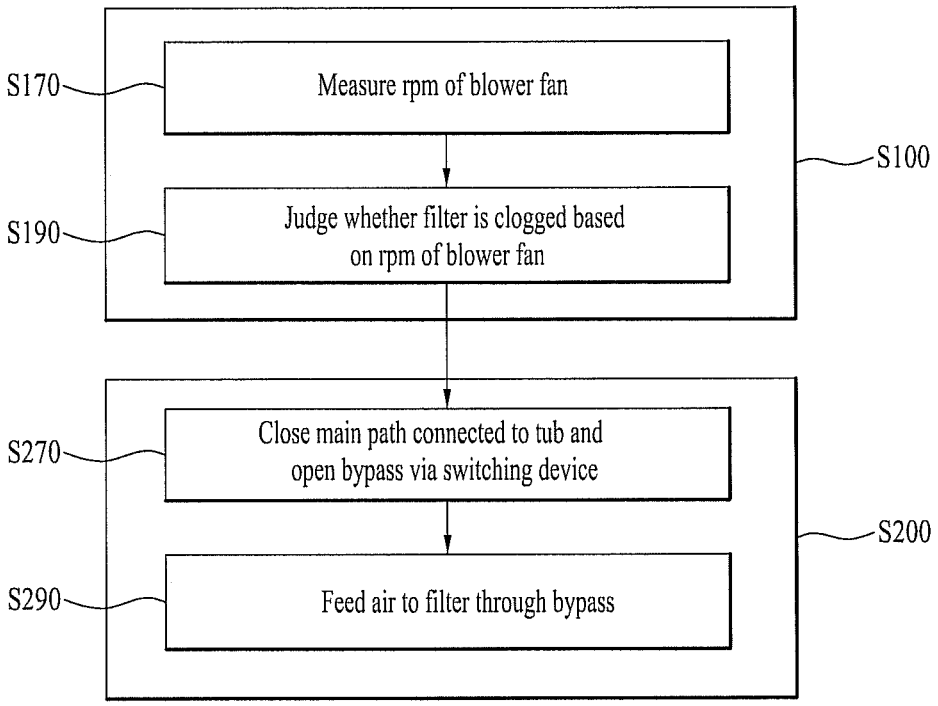

FIGS. 11 to 13 are flowcharts of methods for controlling a clothes treatment apparatus according to embodiments. The methods may be implemented using a clothes treatment apparatus, such as the clothes treatment apparatus discussed with respect to FIGS. 1-8; however, embodiments are not so limited. That is, hereinafter, a method for cleaning a filter of a clothes treatment apparatus according to embodiments will be described with reference to FIGS. 11 to 13. The filter cleaning method, which will be described hereinafter, may be performed during the drying cycle 300 included in the method of controlling a clothes treatment apparatus as described above with reference to FIGS. 9 and 10. Alternatively, the filter cleaning method may be performed while the drying cycle is solely performed, or may be separately performed for cleaning the filter.

As shown in FIG. 11, if clogging of a filter, such as filter 1250 discussed above with respect to the embodiments of FIGS. 1-8, is sensed, in step S100, the flow of air passing through the filter may be switched from the first direction, that is, a normal blowing direction, during the drying cycle to the second direction opposite to the first direction, in step S200.

In accordance with one embodiment, step S100 of sensing clogging of the filter, as shown in FIG. 12, may include measuring at least one of pressure or temperature of air having passed through the filter, step S130, and judging whether the filter is clogged based on data related to at least one of the measured pressure or temperature of air, in step S150.

In the operation of measuring at least one of the pressure or temperature of air, in step S130, the pressure of air may be measured with respect to the air having passed through a blower fan, such as blower fan 1230 discussed above with respect to the embodiments of FIGS. 1-8. The pressure of air may be measured using a pair of pressure sensors, such as pressure sensors 1240 discussed above with respect to the embodiments of FIGS. 1-8, arranged at left and right sides of a drying duct, such as drying duct 1210 discussed above with respect to the embodiments of FIGS. 1-8, between the blower fan and a first end of the drying duct. As such, the pressure of air moving along opposite edges within the drying duct may be measured. Then, if a pressure differential measured by the pair of pressure sensors is greater than a predetermined pressure reference value P0, it may be judged that the filter is clogged, in step S150.

Also, in the operation of measuring at least one of the pressure or temperature of air, in step S130, the temperature of air may be measured with respect to the air having passed through the blower fan. The temperature of air may be measured using a pair of temperature sensors, such as temperature sensors 1220 discussed above with respect to the embodiments of FIGS. 1-8, arranged at left and right sides of the drying duct between the blower fan and one end of the drying duct. As such, the temperature of air moving along opposite edges within the drying duct may be measured. Then, if a temperature differential measured by the pair of temperature sensors is greater than a predetermined temperature reference value T0, it may be judged that the filter is clogged, in step S150.

The pressure reference value P0 and the temperature reference value T0 may be compensated based on the air temperature. More specifically, since the flow rate of air may vary depending on the air temperature under the same clogged state of the filter, the pressure differential sensed by the pressure sensors or the temperature differential sensed by the temperature sensors may be changed. Since a higher air temperature causes an increased change in the flow rate of air, the pressure reference value P0 and the temperature reference value T0 may be changed based on the air temperature, and for example, may be set higher at a higher air temperature than at a lower air temperature.

In accordance with another embodiment, step S100 of sensing clogging of the filter, as shown in FIG. 13, may include measuring revolutions per minute (RPM) of the blower fan, which may blow the air having passed through the filter, in step S170, and judging whether the filter is clogged based on the revolutions per minute of the blower fan, in step S190. If the filter is clogged and the amount of air passing through the blower fan may be reduced, load applied to the blower fan is reduced, and consequently the revolutions per minute of the blower fan may increase.

As such, in the operation of judging whether the filter is clogged, in step S190, it may be judged that the filter is clogged if the measured revolutions per minute of the blower fan exceed the revolutions per minute of the blower fan during normal operation. On the contrary, if the measured revolutions per minute of the blower fan are less than the revolutions per minute of the blower fan during a normal operation, it may be judged that the filter is normal.

One embodiment of an operation of switching the flow of air passing through the filter from the first direction, which is a normal blowing direction during the drying cycle, to the second direction opposite to the first direction, in step S200, will be described in more detail hereinafter with reference to FIG. 12.

To change the flow direction of air passing through the filter, the blower fan, which may be capable of blowing air in a forward or reverse direction, may be provided, and the rotational direction of the blower fan may be changed, in step S230. As the rotational direction of the blower fan may be changed, the flow direction of air may be switched from the first direction to the opposite second direction, in step S250.

According to another embodiment, in the operation of switching the blowing direction, in step S200, as shown in FIG. 13, the flow direction of air may be changed using a bypass, such as bypass 1270 discussed above with respect to the embodiments of FIGS. 1-8, and a switching device, such as the switching device 1280 discussed above with respect to the embodiments of FIGS. 1-8, which may open or close the bypass.

A first end of the bypass may be connected to the drying duct between the blower fan and the filter, and the second end of the bypass may be connected to the drying duct at a position closer to the first end of the drying duct and distal to the blower fan. The switching device may selectively feed air from the bypass and the blower fan to a second side of the tub or to the bypass.

If clogging of the filter is sensed, the switching device may close the main path of the drying duct extending to the second side of the tub, and open the bypass, in step S270. Feeding of air to the drying duct may be temporarily interrupted by the switching device, which may cause air to be fed to the filter through the bypass, in step S290.

In this case, it may be desirable that the pressure of air discharged from the first end of the bypass be greater than the pressure of air introduced into the second end of the bypass, which may be connected to the drying duct toward the second side of the tub. To realize this pressure differential, as shown in FIG. 6, the bypass may be configured such that the area of the second end is greater than the area of the first end, for example.

The above described embodiments may realize removal of lint adhered to the filter by feeding air in the second direction opposite to the first direction, which is the normal air flow direction.

Also, the embodiments with respect to the operation of sensing clogging of the filter, in step S100, as shown in FIGS. 12 and 13, may be independent of the embodiments with respect to the operation of switching the flow direction of air passing through the filter from the first direction to the second direction, in step S200. That is, the method of sensing clogging of the filter using the temperature sensors or the pressure sensors, in steps S130 and S150, and the switching the flow direction of air using the bypass, steps S270 and S290 may be used. Alternatively, the method of sensing clogging of the filter based on revolutions per minute of the blower fan, steps S170 and S190, and the switching the flow direction of air by changing the rotation direction of the blower fan 1230, steps S230 and S250 may be used.

As is apparent from the above description, according to embodiments disclosed herein, treatment of a small amount of clothes or other items may be accomplished in a reduced time and with lower power consumption. Further, according to embodiments disclosed herein, in the case of clothes or other items that have a lower degree of contamination and require simplified treatment, rapid treatment may be applied.

Furthermore, according to embodiments disclosed herein, it may be possible to automatically sense clogging of a filter that filters lint contained in hot air, and to remove lint from the filter when clogging of the filter is sensed, which enables simplified maintenance and repair of the filter without requiring a user's labor. It should be noted that although the above embodiments are described using an example of a clothes treatment apparatus having a tub and a drum rotatably arranged in the tub, such as a combined washing and drying machine, embodiments are also applicable, for example, to a clothes treatment apparatus having no tub, but only a rotatable drum, for example, a clothes dryer.

Embodiments disclosed herein are directed to a clothes treatment apparatus and a method of controlling a clothes treatment apparatus that substantially obviate one or more problems due to limitations and disadvantages of the related art.

Embodiments disclosed herein provide a method of controlling a clothes treatment apparatus capable of reducing a time required for treatment of clothes or other items. Further, embodiments disclosed herein provide a method of controlling a clothes treatment apparatus capable of reducing a time taken to treat a small amount of clothes or other items and required electric power.

Furthermore, embodiments disclosed herein provide a clothes treatment apparatus and a method of controlling a clothes treatment apparatus capable of facilitating easy maintenance and repair of a filter that filters lint contained in hot air.

Embodiments disclosed herein provide a method of controlling a clothes treatment apparatus, such as a dryer and/or a combined drying and washing machine, that may include sensing clogging of a filter located in a drying duct, and switching a flow of air passing through the filter from a first direction to an opposite second direction if clogging of the filter is sensed. The clothes treatment apparatus may comprise a tub and a drum rotatably placed or disposed in the tub or only a rotatable drum. The drying duct may have both ends respectively connected to a first side and a second side of the tub or drum. Interior air of the drum may circulate through the drying duct, and a first blower fan may be located in the drying duct to enable circulation of interior air of or within the drying duct. The filter may be provided near the first side of the tub or drum to remove lint contained in the air circulating through the drying duct.

The switching of the flow of air to the second direction may include changing a rotation direction of a blower fan provided in the drying duct to switch the flow of air. Alternatively or additionally, a main path extending through the filter and the first blower fan and connected to a second side of the tub or drum of the clothes treatment apparatus may be closed, and a bypass having a first end connected to the main path between the filter and the first blower fan and a second end connected to the main path between the first blower fan and the second side of the tub or drum may be opened. It may also be possible to operate a second blower fan adapted to provide an air flow in the second direction. The second blower fan may be located on the other side of the filter than the first blower fan, for example, between the filter and the first side of the tub or drum.

The sensing of clogging of the filter may include measuring at least one of a pressure or temperature of air passing through the drying duct, and judging whether the filter is clogged based on data of at least one of the measured pressure or air temperature.

The pressure of air having passed through the first blower fan provided in the drying duct may be measured, and it may be judged that the filter is clogged if a pressure differential of air moving along opposite sides within the drying duct is greater than a predetermined pressure reference value. The pressure reference value may be compensated based on the air temperature.

The air temperature having passed through the first blower fan provided in the drying duct may be measured, and it may be judged that the filter is clogged if a temperature differential of air moving along opposite sides within the drying duct is greater than a predetermined temperature reference value. The temperature reference value may be compensated based on the air temperature.

The temperature and/or pressure may be sensed at opposing sides of the drying duct near an outlet of the first blower fan, for example, where the air blown by the blower fan exits the blower fan.

The sensing of clogging of the filter may include measuring revolutions per minute of the first blower fan, which may blow air having passed through the filter, and judging that the filter is clogged if the measured revolutions per minute of the first blower fan are greater than revolutions per minute of the first blower fan during normal operation, and judging that the filter is normal if the measured revolutions per minute of the first blower fan are equal to or less than the revolutions per minute of the first blower fan during normal operation.

Embodiments disclosed herein further provide a clothes treatment apparatus, such as a dryer and/or combined washing and drying machine, which may include a drying duct with a blower fan and a filter, and a sensing means for sensing or sensor that senses clogging of the filter. The sensing means may include at least one of one or more temperature sensors or one or more pressure sensors. Alternatively or additionally, a controller may be provided that is adapted to sense clogging based on revolutions per minute of the blower fan.

The clothes treatment apparatus may also include a switching means for reversing or switching device that reverse a flow of air passing through the filter, if clogging is sensed. By reversing the air flow, the filter may be cleared. However, instead of providing the switching means or in addition to the switching means, there may be provided an indication means for indicating or an indicator that indicates to a user that the filter is clogged, so that the user may manually clean the filter. The switching means may include a separate flow path that changes the air flow direction through the filter, that is, a bypass. Additionally, the switching means may include a switching element adapted to open the bypass and to close a main path, if clogging is sensed. Alternatively or additionally, a controller may be provided which is adapted to change the air flow direction by reversing the rotation direction of the blower fan or by operating a second blower fan arranged at a side of the filter facing away from the first blower fan.

Embodiments disclosed herein further provide a clothes treatment apparatus, such as a dryer and/or a combined drying and washing machine, that may include a drying duct having both ends connected to a first side and a second side of a tub or a drum of the clothes treatment apparatus. Interior air of the tub or drum may circulate through the drying duct. A blower fan may be located in the drying duct to enable circulation of the interior air within the drying duct. A filter may be provided near a first side of the tub or drum to remove lint contained in the air circulating through the drying duct. The drying duct may include a main path, which may extend through the filter and the blower fan and may be connected to a second side of the tub or drum, and a bypass, which may have a first end connected to the main path between the filter and the blower fan and a second end connected to the main path between the blower fan and the second side of the tub or drum. The clothes treatment apparatus may further include a switching unit or device that selectively feeds air, introduced into the drying duct, to the bypass or to the second side of the tub. In the case of the bypass, an area of the second end of the bypass may be greater than an area of the first end of the bypass.

Instead of the drying duct including a main path and a bypass or in addition thereto, the blower fan may be operable in two rotation directions, thus being able to provide an air flow passing through the filter in a first direction and in a second opposite direction. As a further alternative or additionally, a second blower fan may be provided, the blower fans being located on both sides of the filter, so that by operating either the first blower fan or the second blower fan, the direction of the air flow through the filter may be switched. The blower fans each may be a sirocco fan that blows forwardly introduced air laterally.

The clothes treatment apparatus may further include a pair of pressure sensors located in the main path between the blower fan and the second side of the tub or drum. The pair of pressure sensors may be arranged, respectively, at opposite edges of the drying duct. The switching unit may feed air to the bypass if a pressure differential measured by the pair of pressure sensors is greater than a predetermined pressure reference value.

The clothes treatment apparatus may further include a pair of temperature sensors located in the main path between the blower fan and the second side of the tub. The pair of temperature sensors may be arranged, respectively, at opposite edges of the drying duct. In this case, the switching unit may feed air to the bypass if a temperature differential measured by the pair of temperature sensors is greater than a predetermined temperature reference value.

Embodiments disclosed herein further provide a clothes treatment apparatus, such as a dryer and/or a combined drying and washing machine, that may include a drying duct having both ends connected to a first side and a second side of a tub or drum of the clothes treatment apparatus. Interior air of the tub may circulate through the drying duct. A blower fan may be located in the drying duct to enable circulation of the interior air within the drying duct. A filter may be provided near a first side of the tub or drum to remove lint contained in the air circulating through the drying duct. A sensing means for sensing or a sensor that senses clogging of the filter may be provided. The sensing means may include at least one of a pair of temperature sensors or a pair of pressure sensors provided between the blower fan and the second side of the tub or drum. The pair of temperature sensors or the pair of pressure sensors, respectively, may be arranged at opposite sides of the drying duct, that is, near an outlet of the blower fan. The pair of pressure or temperature sensors may be arranged in the drying duct in a plane of rotation of the blower fan. In a case that the blower fan is a sirocco fan that blows air sideways, a clogging of the filter may cause different temperatures and/or pressures at opposing sides of the drying duct at an outlet of the blower fan. Thus, by measuring the temperature and/or pressure at these positions in the drying duct, clogging of the filter may be detected.

Moreover, the clothes treatment apparatus may include a switching means for reversing or a switching device that reverses a flow direction of air passing through the filter. The switching means may include a controller that changes a rotation direction of a blower fan in an opposite direction, if a temperature differential between the pair of temperature sensors or a pressure differential between the pair of pressure sensors is greater than a preset value. Alternatively or additionally, if it is sensed that the filter is clogged, the controller may control the switching means to switch an air flow from a main path, which may extend through the filter and the blower fan, to a bypass, which may have one end connected to the main path between the filter and the blower fan and the other end connected to the main path between the blower fan and a second side of the tub or drum. The controller may also operate a second blower fan arranged on an opposite site of the filter than the first blower fan in order to reverse the air flow through the filter.

Embodiments disclosed herein further provide a method of controlling a clothes treatment apparatus that may include a washing cycle for washing clothes or other items, and a drying cycle for drying the clothes or other items, when the washing cycle is completed. An implementation time of the washing cycle may be less than an implementation time of the drying cycle.

The method may further include judging whether an amount of clothes or other items is equal to or less than a preset value, before the washing cycle. The preset value may be, for example, approximately 3 lbs. Further, a sum of the implementation times of the washing cycle and the drying cycle may be less than approximately 1 hour. The method may further include notifying a user of the judged result that the amount of clothes or other items is not equal to or less than the preset value.

The washing cycle may include a washing operation for washing clothes or other items, a rinsing operation for rinsing the clothes or other items, and a first dehydration operation for removing water from the clothes or other items. A first water supply operation for supplying water may be performed before the washing operation. A second water supply operation for supplying water may be performed before the rinsing operation.

Warm water may be fed during the second water supply operation. During implementation of the drying cycle, hot air may be fed to dry clothes or other items until the drying cycle is completed. A drainage operation for discharging water may be performed after the washing operation.

The drying cycle may include a first drying operation for drying clothes or other items, a second dehydration operation for removing water from the clothes or other items, and a second drying operation for drying the clothes or other items. If warm water is used the rinsing operation of the washing cycle, hot air may be continuously fed to dry the clothes or other items throughout the drying cycle.

Embodiments disclosed herein further provide a clothes treatment apparatus, such as a combined washing and drying machine, adapted to perform a method according to any one of the above described methods and may include a washing cycle for washing clothes or other items, and a drying cycle for drying the clothes or other items, when the washing cycle is completed, wherein an implementation time of the washing cycle is less than an implementation time of the drying cycle.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A clothes treatment apparatus, comprising:

a drying duct, through which air is suctioned in at an upper rear side of an outer circumferential surface of a tub and supplied to a front side of the tub;

a first blower fan located in the drying duct that circulates interior air within the drying duct;

a filter provided adjacent to the outer circumferential surface of the tub to remove lint contained in the air circulating through the drying duct; and a sensor that senses clogging of the filter, wherein the clothes treatment apparatus is configured to switch a flow of air from the outer circumferential surface of the tub to a front side of the tub to a flow of air from the front side of the tub to the outer circumferential surface of the tub so as to separate lint attached to the filter, if the clogging of the filter is sensed.

2. The clothes treatment apparatus according to claim 1, wherein the drying duct includes:

a main path that extends through the filter and the first blower fan; and a bypass, through which the flow of air is bypassed to direct air from the front side of the tub to the outer circumferential surface of the tub.

3. The clothes treatment apparatus according to claim 2, wherein the main path is connected to the front side of the tub, and the bypass includes a first end connected to the main path between the filter and the first blower fan and a second end connected to the main path between the first blower fan and the front side of the tub.

4. The clothes treatment apparatus according to claim 3, wherein an area of the second end of the bypass is greater than an area of the first end of the bypass.

5. The Clothes treatment apparatus according to claim 3, further comprising a switching device that selectively feeds air, introduced into the drying duct, to the bypass or to the front side of the tub.

6. The clothes treatment apparatus according to claim 5, wherein the switching device comprises a rotatable plate.

7. The clothes treatment apparatus according to claim 1, wherein the first blower fan is a sirocco fan that blows forwardly introduced air laterally.

8. The clothes treatment apparatus according to claim 1, wherein a rotational direction of the first blower fan reversed to switch the flow of air from the outer circumferential surface of the tub to the front side of the tub to the flow of air from the front side of the tub to the outer circumferential surface of the tub.

9. The clothes treatment apparatus of claim 1, wherein a second blower fan is provided that provides a flow of air from the front side of the tub to the outer circumferential surface of the tub, and wherein the second blower fan is located in the drying duct on a side of the filter opposite to a side on which the first blower fan is located.

10. The clothes treatment apparatus according to claim 1, wherein the sensor comprise at least one of a pair of pressure sensors or a pair of temperature sensors provided in the drying duct.

11. The clothes treatment apparatus according to claim 10, wherein the at least one of the pair of pressure sensors or the pair of temperature sensors are provided in the drying duct adjacent the first blower fan.

12. The clothes treatment apparatus according to claim 10, wherein the at least one of the pair of pressure sensors or the pair of temperature sensors are disposed adjacent opposite edges of the drying duct.

13. The clothes treatment apparatus according to claim 10, wherein the flow of air is switched to the flow of air from the front side of the tub to the outer circumferential surface of the tub, if at least one of a temperature differential between the pair of temperature sensors or a pressure differential between the pair of pressure sensors is greater than a predefined value.

14. The clothes treatment apparatus according to claim 5, wherein the switching device is located in the main path at a position where the second end of the bypass is connected to the main path.

15. The clothes treatment apparatus according to claim 14, wherein the switching device is configured to selectively simultaneously close the bypass and open the main path between the first blower fan and the front side of the tub to flow the air from the first blower fan to the front side of the tub.

16. The clothes treatment apparatus according to claim 14, wherein the switching device is configured to selectively simultaneously open the bypass and close the main path between the first blower fan and the front side of the tub so that the air is introduced into the first end of the bypass through the second end of the bypass after passing through the first blower fan to separate the lint attached to the filter.

17. The clothes treatment apparatus according to claim 16, wherein the first end of the bypass extends to face the filter.

* * * * *